United States Patent [19]

Marsh

[11] 3,996,995

[45] Dec. 14, 1976

[54] CONTINUOUS CASTING MOULD

[75] Inventor: John Marsh, Bedford, England

[73] Assignee: Davy International Limited, London, England

[22] Filed: Nov. 26, 1975

[21] Appl. No.: 635,289

[30] Foreign Application Priority Data

Nov. 28, 1974 United Kingdom ..... 51625/74

[52] U.S. Cl. ..... 164/283 M; 164/283 R

[51] Int. Cl.[2] ..... B22D 11/04; B22D 11/124

[58] Field of Search ..... 164/283 R, 283 S, 283 M

[56] References Cited

UNITED STATES PATENTS

| | | | |
|---|---|---|---|
| 2,169,893 | 8/1939 | Crampton et al. | 164/283 M |
| 3,572,420 | 3/1971 | Summers | 164/283 M X |
| 3,713,479 | 1/1973 | Bryson | 164/283 R X |
| 3,882,924 | 5/1975 | Fujikawa | 164/283 R |
| 3,885,617 | 5/1975 | Foye | 164/283 |

FOREIGN PATENTS OR APPLICATIONS

| | | | |
|---|---|---|---|
| 530,718 | 9/1956 | Canada | 164/283 M |
| 1,050,029 | 2/1959 | Germany | 164/283 M |

*Primary Examiner*—Ronald J. Shore
*Attorney, Agent, or Firm*—Brisebois & Kruger

[57] ABSTRACT

The mould cavity in a metal body forming part of a continuous casting mould is extended by way of a cavity in a second metal body arranged in line with the mould cavity, each body has separate means by which liquid coolant can be supplied to the outer surface of the body and the means associated with the second body permits the coolant supplied to the body to flow over the end of the body which is away from the first body.

5 Claims, 1 Drawing Figure

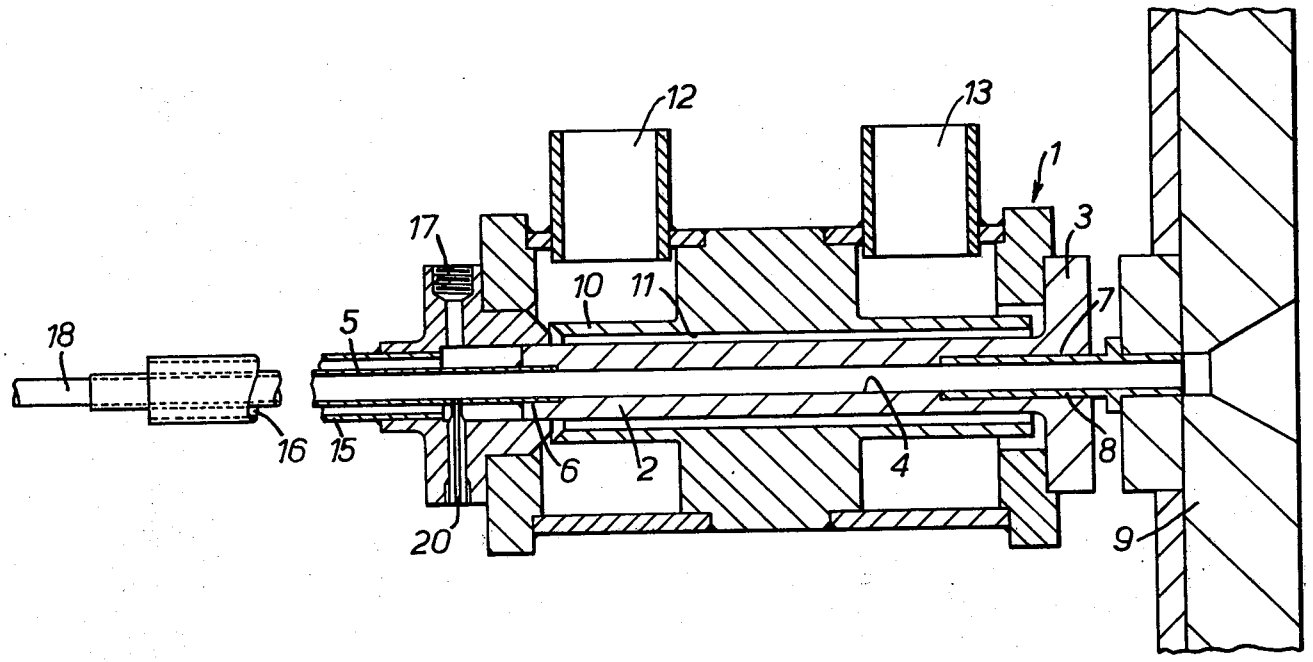
1
2
3
4
5
6
7
8
9
10
11
12
13
15
16
17
18
20

CONTINUOUS CASTING MOULD

This invention relates to a mould suitable for the continuous casting of metal.

In known continuous casting techniques it is usual for an ingot to be formed from molten metal in a liquid cooled mould and for the ingot to be cooled after it leaves the mould by having a liquid coolant, usually water, sprayed on to it. Although several spray nozzles may be used, the nozzles being directed at different parts of the surface of the ingot, uniform coverage of the ingot with liquid coolant does not always occur and this can lead to uneven cooling of the ingot. While the ingot is at an elevated temperature, oxidation of the surface of the ingot occurs and consequently if the surface of the ingot has parts which are not cooled quickly then these parts may be subjected to oxidation.

It is an object of the present invention to provide a continuous casting mould which brings about uniform and efficient cooling of the ingot thus reducing the chances of oxidation occurring.

According to the present invention a continuous casting mould includes a first metal body having a mould cavity therethrough, a second metal body arranged so that a cavity therethrough forms an axial extension of the mould cavity, and each body having separate means associated therewith by which liquid coolant can be supplied to the outer surface of the body, the means associated with the second body permitting liquid coolant supplied to the body to flow over the end of the body which is away from the first body.

In use, the quantity of coolant supplied to the first body is sufficient to cause the molten metal to solidify in the mould cavity to form a skin which encloses and contains a liquid or pasty core. On entering the cavity provided by the second metal body, the ingot undergoes further cooling so that on leaving the cavity in the second body the ingot is cool enough to prevent oxidation of the surface from occurring. Much of the liquid coolant which is supplied to the second body flows over the end of the body and on to the surface of the ingot in the form of a curtain surrounding the ingot and this provides further cooling. It has been found that additional cooling for the ingot in the form of a water spray is not required.

Preferably the second member is a metal tube having a bore with the same cross-sectional dimensions as those of the mould cavity, the tube being arranged with respect to the first body so that the bore of the tube is aligned with, and forms an extension of, the mould cavity.

Provision may be made to further reduce oxidation of the surface of the ingot as it passes through the second metal body. To this end an inert or a reducing gas can be introduced into the bore of the second metal body. Alternatively, a liquid lubricant may be introduced into the bore of the body.

In order that the invention may be more readily understood it will now be described, by way of example only, with reference to the accompanying drawing which is a sectional side elevation through a continuous casting mould.

A continuous casting mould 1 includes a one-piece metal body 2 in the form of a tube having a flange 3 at one end. The tube, which is conveniently of copper, has a mould cavity 4 extending therethrough and the tube is arranged so that the axis of the mould cavity is horizontal. A second metal body in the form of a tube 5 has a bore therethrough having the same cross-sectional dimensions as those of the mould cavity 4. The tube, which is conveniently of copper, is arranged so that its bore is aligned with the mould cavity and forms an extension thereof. One end of the tube 5 fits into a recessed portion 6 at the outlet end of the tube 2.

At the inlet end of the tube 2 there is also a recessed portion 7 which receives an end portion of a feed tube 8 of either graphite or a material having a similar thermal conductivity and coefficient of friction to graphite. The other end of the feed tube 8 projects into an opening in the wall of a tundish 9 and the tube serves to feed molten metal from the tundish 9 into the tube 2.

The tube 2 has a jacket 10 around it over the greater portion of its length and between the jacket and the tube 2 there is a space 11 through which liquid coolant, usually water, can flow from an inlet duct 12 to an outlet duct 13. The liquid coolant in the space 11 cools the tube 2 sufficiently for a skin to be formed in the tube which contains a liquid or pasty core of molten metal.

The extension tube 5 is surrounded, over the greater portion of its length, by a jacket 15 which is secured at one end to a part of the jacket 10. There is a space 16 between the tube 15 and the outer surface of the tube 5 and into this space liquid coolant, usually water, is introduced through an inlet duct 17.

At the end of the tube 5 which is away from the tube 2, the space between the tube 2 and the jacket 15 is open to the atmosphere and liquid coolant introduced into the space flows out of the space at this end and most of the coolant flows over the end of the tube 5 into contact with the ingot 18 as it leaves the outlet end of the tube 5. The ingot has already been cooled to a considerable extent during its passage through the tube 5 and with the further cooling provided by the coolant flowing over the end of the tube 5, no further cooling sprays are required.

As the casting passes through the tube 5 there is little opportunity for surface oxidation to form, but to provide an even further safeguard a reducing or inert gas can be introduced into the bore of the tube 5 through a duct 20 which leads to the bore of the tube 5 adjacent its end which adjoins the tube 2. As an alternative to a reducing or inert gas, a liquid lubricant can be introduced into the bore of the tube 5 by way of the duct 20.

The supplies of liquid coolant to the space 11 and to the space 16 around the tube 5 are independently controlled by means not shown so that the flow of liquid in the space 11 is greater than that through the space between the tube 5 and its jacket. The flow of coolant to the space 16 can, if required, be shut off whilst a flow of coolant to the space 11 continues.

I claim:

1. A continuous casting mould including a first metal body defining a mould cavity therethrough, means associated with the body by which liquid coolant can be supplied to the outer surface of the body, a second metal body in the form of a tube having a bore with substantially the same cross-sectional dimensions as those of the mould cavity, said bodies being arranged such that the longitudinal axis of the mould cavity and the tube are substantially horizontal and aligned so that the bore in the second body forms an axial extension of the mould cavity, and means associated with the second body by which liquid coolant can be supplied to the outer surface of the tube and allowed to flow over the end of the tube which is away from the first body.

2. A continuous casting mould as claimed in claim 1 in which the means associated with the first body comprises a jacket arranged around the body at least over the major part of its length with a space between the body and the jacket and inlet and outlet ducts for liquid coolant leading to said space.

3. A continuous casting mould as claimed in claim 1 in which the means associated with the second body comprises a jacket arranged around the body at least over the major part of its length with a space between the body and the jacket, an inlet duct for liquid coolant leading to said space which space is open to atmosphere adjacent the end of the member which is away from the first member.

4. A continuous casting mould as claimed in claim 1 including a duct through which a gas or a liquid lubricant can be introduced into the bore in the second metal body at a position adjacent the first member.

5. A continuous casting mould including a first metal body defining a mould cavity therethrough, a metal tube having a bore therethrough with the same cross-sectional dimensions as the mould cavity, the body and the tube being arranged in end-to-end relation so that the bore of the tube is aligned with the mould cavity, a jacket positioned around the metal body over at least the major part of its length to define a space between the body and the jacket, inlet and outlet ducts for liquid coolant leading to said space, a jacket arranged around the tube at least over the major part of its length to define a space between the tube and the jacket, said space being open to atmosphere at the end of the tube which is away from the first body and an inlet duct for liquid coolant leading to said space.

* * * * *